US006473997B1

(12) United States Patent
Berg

(10) Patent No.: US 6,473,997 B1
(45) Date of Patent: Nov. 5, 2002

(54) METHOD AND DRYING SECTION FOR DEWATERING A FIBROUS WEB

(75) Inventor: Carl-Gustav Berg, Åbo (FI)

(73) Assignee: Equitor OY, Grankulla (FI)

( * ) Notice: Subject to any disclaimer, the term of this patent is extended or adjusted under 35 U.S.C. 154(b) by 0 days.

(21) Appl. No.: 09/786,428

(22) PCT Filed: Sep. 3, 1999

(86) PCT No.: PCT/FI99/00718

§ 371 (c)(1),
(2), (4) Date: Apr. 9, 2001

(87) PCT Pub. No.: WO00/14329

PCT Pub. Date: Mar. 16, 2000

(30) Foreign Application Priority Data

Sep. 4, 1998 (FI) ..... 981898

(51) Int. Cl.[7] ..... F26B 3/00; F26B 11/02

(52) U.S. Cl. ..... 34/463; 34/448; 34/452; 34/115; 34/122; 34/124

(58) Field of Search ..... 34/446, 448, 452, 34/453, 463, 465, 114, 115, 116, 119, 120, 122, 124; 162/206, 207

(56) References Cited

U.S. PATENT DOCUMENTS

| | | | | |
|---|---|---|---|---|
| 4,942,675 A | | 7/1990 | Sundqvist | |
| 5,383,288 A | * | 1/1995 | Ilmarinen et al. | 34/392 |
| 5,862,613 A | | 1/1999 | Kerttula et al. | |
| 6,138,380 A | * | 10/2000 | Veijola et al. | 34/446 |
| 6,189,237 B1 | * | 2/2001 | Mayer et al. | 34/452 |
| 6,294,050 B1 | * | 9/2001 | Oechsle et al. | 162/207 |
| 6,364,999 B1 | * | 4/2002 | Speaks et al. | 162/25 |

FOREIGN PATENT DOCUMENTS

| | | |
|---|---|---|
| CA | 2025408 A1 | 3/1991 |
| DE | 34 45 615 A1 | 6/1986 |
| EP | 0 559 628 A1 | 9/1993 |
| EP | 0 655 528 B1 | 5/2000 |
| FI | 80104 | 12/1989 |
| JP | 5222692 | 8/1993 |
| WO | WO 92/12291 A1 | 7/1992 |

OTHER PUBLICATIONS

International Search Report, PCT/FI99/00718, completed Dec. 10, 1999.
Finnish Search Report, Appl. No. 981898, completed Mar. 29, 1999.

* cited by examiner

*Primary Examiner*—Pamela Wilson
(74) *Attorney, Agent, or Firm*—Alston & Bird LLP

(57) ABSTRACT

The invention relates to a method and a drying section for dewatering a fibrous web (9), the drying section preferably being intended to dry fibrous webs in a paper machine, and the drying section comprising a number of drying cylinders (8), by which an inlet and outlet nip are formed when running the fibrous web, and the drying section comprising drying devices for decreasing the moisture content of the fibrous web, the drying devices comprising a blow device for blowing air in the proximity of the surface of the fibrous web. For the purpose of significantly increasing the speed of the paper machine or other machine and to be able to reduce the number of drying cylinders (8), and to reduce construction and operating costs upon dewatering, the drying section is characterized in that the drying devices comprise a porous drying cylinder (8) against which the fibrous web (9) is arranged to be guided wirelessly, a heating means (12) arranged at a distance from the shell surface of the porous drying cylinder (8) and guided against the fibrous web (9) and drying cylinder, for heating the fibrous web, the heating means being based on heating with rays having a wavelength which activates water molecules, and a blow device (15) comprising lateral blow devices arranged to provide a humid airflow which sweeps lengthwise along the surface of the fibrous web (9).

16 Claims, 3 Drawing Sheets

METHOD AND DRYING SECTION FOR DEWATERING A FIBROUS WEB

BACKGROUND OF THE INVENTION

The invention relates to a method of dewatering a fibrous web in a drying section, preferably a paper web, cellulose web or cardboard web in a paper machine, the drying section comprising a number of drying cylinders, by which an inlet and outlet nip are formed when running the fibrous web, the drying section comprising drying devices for decreasing the moisture content of the fibrous web.

The invention also relates to a drying section for dewatering a fibrous web, the drying section preferably being intended to dry fibrous webs in a paper machine, such as paper webs, cellulose webs or cardboard webs, and the drying section comprising a number of drying cylinders, by which an inlet and outlet nip are formed when running the fibrous web, and a blow device for blowing air in the proximity of the surface of the fibrous web.

A drying section is an essential part of a paper machine. The drying section serves to decrease the initially high moisture content of a paper web (or other fibrous web) so that its dry content increases to about 90 to 97% when it leaves the drying section. Paper machines have become increasingly fast, and this has led to the need to make their drying sections correspondingly longer. In practice, this means that the drying section may be a voluminous part of the paper machine having a considerable length, for example 80 meters, and comprising a plurality of drying cylinders.

It is naturally desirable to accomplish a drying section so as to further increase the travel speed of the fibrous web, i.e. the speed of the paper machine, from what is customary, without making the drying section too complicated and large. Blowing hot air towards a paper web is a means for decreasing the length of the drying section. In spite of this, the drying section is a very complicated construction.

In this context, the concepts 'humid air' and 'air' refer to a combination of dry air and water vapour.

BRIEF DESCRIPTION OF THE INVENTION

The object of the present invention is to provide a significant improvement to the drying section in machines processing fibrous webs, paper machines, for example, in such a way that the speed of the machines can be considerably increased and, simultaneously, the number of drying cylinders can be decreased and the construction and operating costs lowered.

This object is achieved by the method of the invention, characterized by guiding the fibrous web wirelessly against a porous drying cylinder, heating the fibrous web by radiation heat directed towards the fibrous web and the drying cylinder, and providing by means of lateral blowing a humid airflow which sweeps in the machine direction along the surface of the fibrous web.

This object is achieved by the drying section of the invention, characterized in that the dewatering devices comprise

- a porous drying cylinder against which the fibrous web is arranged to be guided wirelessly,
- a heating means arranged at a distance from the shell surface of the porous drying cylinder and directed towards the fibrous web and drying cylinder, for heating the fibrous web, the heating means being based on heating with rays having a wavelength which activates water molecules, and
- the blow device comprising lateral blow devices arranged to provide a humid airflow which sweeps along the surface of the fibrous web.

The heating employs electromagnetic waves, preferably IR rays (infrared rays) or microwaves.

The lateral blow devices are preferably arranged to blow in a direction opposite to that of the movement of the fibrous web, resulting in more rapid dewatering.

When the heating means is of a type based on gas energy, and the flame heat is guided without hindrance against the fibrous web, particularly good heat transfer and a dewatering process having a high efficiency are achieved. Guiding heat without hindrance means herein that a heat absorbing material (for example a ceramic material) is only partially present between the fibrous web and the flame to achieve the desired wavelength spectrum which thus allows optimal heat distribution and efficiency.

To further accelerate the dewatering process, blow devices are preferably used for blowing humid air along the inside of the drying cylinder, the air pressure being held lower than the air pressure acting above the fibrous web. This allows moisture to be conveyed from the fibrous web through the drying cylinder, too. This embodiment enables moisture removal from both sides of the fibrous web. Part of the discharge air can also be used to heat the inlet air.

Preferred embodiments of the invention are disclosed in the attached claims 3 to 16.

The use of heating means based on heating by electromagnetic waves, for instance infrared rays, allows the surface temperature of a fibrous web to be increased even though the fibrous web is conveyed at a high speed, for example 20 to 40 m/s. The blow devices allow the moisture to be freed from the fibrous web and discharged rapidly.

The most important advantage of the invention is a more rapid dewatering process, which can be achieved at the same time as the construction and operating costs can be kept lower than usual. The number of drying cylinders can be substantially reduced, to about ⅕ of the number of drying cylinders in conventional cylinder drying. The costs per kilo of evaporated water are substantially reduced, compared with conventional paper machines, by 20 to 40%. The heat energy based on electromagnetic waves can be transferred effectively, while the remaining heat energy is transferred parallel to the radiation energy in the form of forced convection and guidance through the porous cylinder. The drying section of the invention enables an even dry content and an end product of high and uniform quality. The uniform quality is guaranteed by the fibrous web being attached during the dewatering process and by double-sided evaporation and by subjecting the fibrous web only to very slight mechanical stress. An even dry content in the end product is ensured simply by a number of IR heating units on the last drying cylinders of the drying section.

DESCRIPTION OF THE FIGURES

In the following the invention will be described by means of a preferred embodiment with reference to the attached drawing, in which.

DETAILED DESCRIPTION OF THE INVENTION

Figure 1:
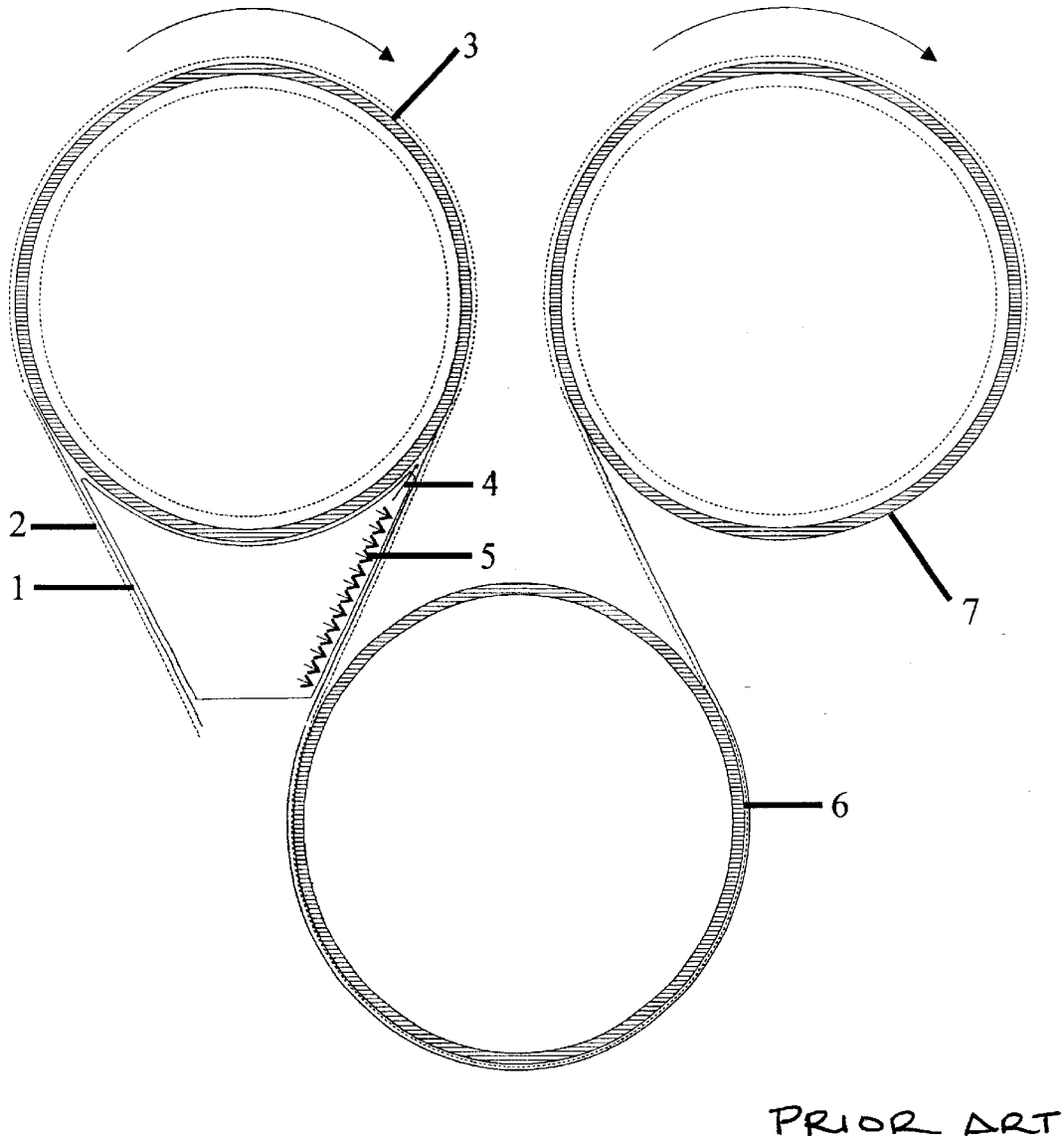
FIG. 1 shows a part of the drying section in a conventional paper machine.

FIG. 1 shows a part of a drying section in a conventional paper machine. A paper web 1, or other fibrous web, is conveyed at a speed of about 20 m/s, supported against a wire 2, with the paper web lying between the wire and a drying cylinder 3. Air blow devices 5 for blowing against the paper web 1 are arranged by an outlet nip 4 of the drying cylinder. Blowing air accelerates the dewatering of the paper web 1. After the drying cylinder 1, the paper web is conveyed over cylinders 6 and 7. As a whole, the drying section comprises several dozens of drying cylinders 3.

Figure 2:
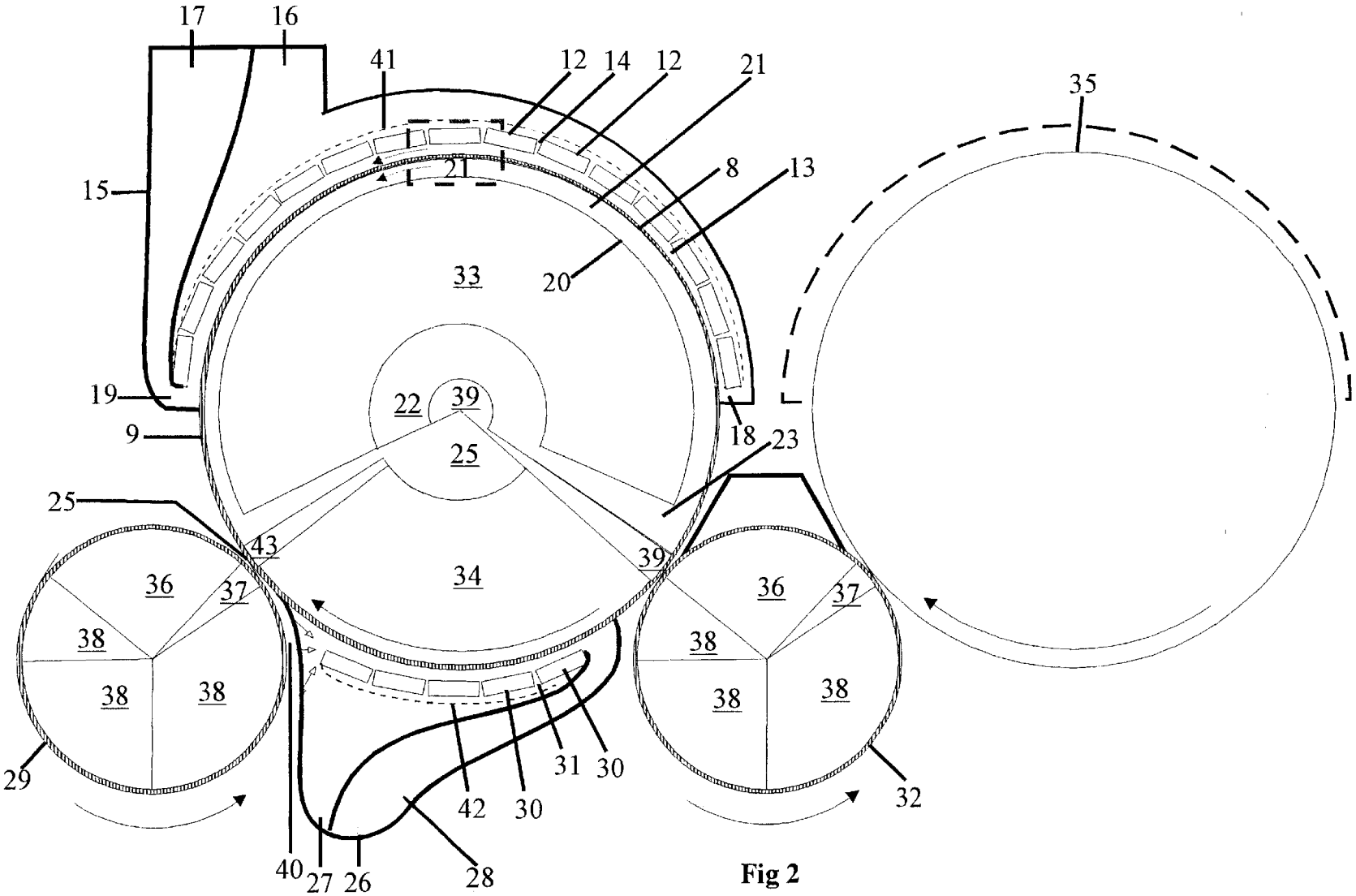
FIG. 2 is a drying section according to the invention.

FIG. 2 shows a part of a drying section of the invention. The drying section comprises a drying cylinder 8 on which a paper web 9, or other fibrous web, such as a cellulose or cardboard web, is conveyed. The paper web 9 is conveyed wirelessly. Reference numerals 29 and 32 denote turning cylinders which may have a conventional construction.

The drying cylinder 8 is porous such that it allows moisture to be conveyed from its shell surface 10 against its inner surface 11. The drying cylinder 8 is porous because it is made of a sintered material. The material is suitably metal or ceramic or a mixture thereof. It is also feasible that the porosity is provided by a perforated metal cylinder. The material the drying cylinder 8 is made from has preferably a relatively high heat conductivity.

Heating means comprising a plurality of heating units 12 are arranged at a distance from the shell surface 10 of the drying cylinder along the length of the drying cylinder 8.

The heating units 12 are based on heating by electromagnetic waves, a suitable implementation very likely being IR waves with gas as the energy source. Apertures (not shown) in the heating units allow heat from the flame to radiate without hindrance against the upper surface of the paper web 9. This provides high heat transfer intensity and high efficiency upon heating of the paper web 9. The paper web 9 is considerably heated despite its very high speed, 25 m/s, for example.

The heating units 12 are placed so as to follow the shape of the drying cylinder 8 such that a first air flow conduit 13 is formed between the heating units and the paper web 9. In FIG. 2, the heating units 12 extend along about 180° of the periphery of the drying cylinder 8, but could be contemplated to extend within a significantly narrower or wider area. In practice, a usable interval could be for example 40 to 340° of the periphery of the drying cylinder 8. To provide effective heat supply, heating units that are arranged along an area of at least 100° of the periphery of the heating cylinder are, however, preferred. The height of the flow conduit 13 may be suitably 2 to 200 mm. An air gap 14 in the longitudinal direction of the drying cylinder 8 is arranged between adjacent heating units 12.

The temperature of the air in the flow conduit 13 is between 200 and 400° C. such that the temperature in the rightmost heating unit in FIG. 2, for example, is several dozens of degrees, typically about 100° C. higher than the temperature in the leftmost heating unit in FIG. 2.

Figure 3:
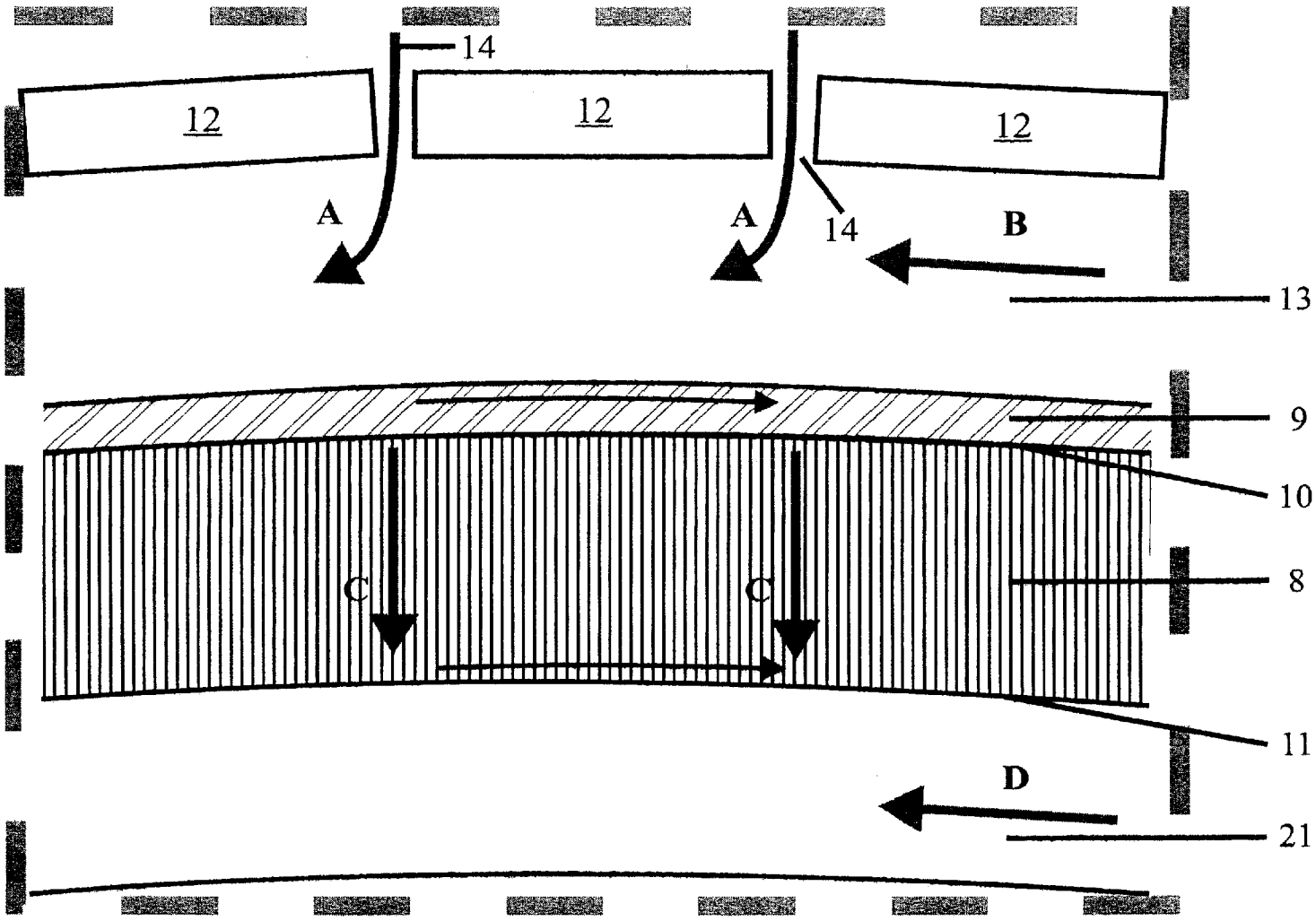
FIG. 3 is a partial enlargement of FIG. 2.

FIG. 2 shows that a casing 15 encircles the heating units 12 and the flow conduit 13. The casing 15 is provided with an inlet 16 for supply air from a blow device, and an outlet 17 for discharged air having a higher moisture content. Reference numeral 41 denotes an inner cover through which air is allowed to flow. To this end, the cover 41 is provided with a hole. The use of a porous cover 41 is feasible. Air is blown in and guided as shown by arrows A and B in FIG. 3. Arrows A denote air blown above and through the gaps 14, and arrow B denotes air which, because of the shape and construction of the casing 15, is blown along the paper web 9 from a blockage 18 at one end of the first flow conduit 13. Consequently, the lateral blow, which provides a humid air flow sweeping lengthwise along the surface of the paper web 9, is provided in a direction opposite to the movement of the paper web and the drying cylinder 8. Thus, the blowing device, the casing 15 and the cover 41 may be said to form both a through-blowing device and a lateral blowing device.

Part of the air discharged from the outlet 17 can be used for heating the air supplied to the inlet 16. This provides better efficiency.

Within the drying cylinder 8 is arranged an air flow which sweeps along the inner surface 11 of the drying cylinder in a direction opposite to the direction of movement of the drying cylinder. The air flow is provided by a cylinder-like air guiding device 20 having a central longitudinal conduit 39. The air guiding device 20 forms between its outer periphery and the inner surface 11 of the drying cylinder a flow conduit 21 for air. The flow conduit 21 extends along the length of the drying cylinder 8 and about 200° of its periphery. However, the flow conduit 21 may extend along a significantly shorter or longer distance along the periphery of the drying cylinder 8. The air is supplied to the flow conduit 21 from an air inlet 22 arranged in the central conduit 39 of the air guiding device 20, via a gap 23 extending in the longitudinal direction of the air flow device (and the drying cylinder 8).

Consequently, the air which is guided by the air guiding device 20, is supplied laterally to the drying cylinder 8.

Because the air inlet 22 is coupled to the outlet 17 from which heated air flows, the air in the flow conduit 21 is heated to a temperature of 100 to 300° C., preferably 150 to 200° C. The difference between the temperatures of the air in the flow conduits 13 and 21 is 50 to 100° C., such that the temperature in the flow conduit 21 in the proximity of the end 18 is about 200° C., and the temperature in the flow conduit in the proximity of the end 19 is about 150° C.

The air is guided from the air inlet 22 along a gap 24 extending in the longitudinal direction of the air guiding device 20 towards the centre of the air guiding device, the centre being provided with an air outlet 25 for humid air.

The heat of the humid air discharged from the air outlet 25 is utilized in initial blowing inside the casing 15.

The pressure in the flow conduit 21 is arranged somewhat lower than the pressure in the flow conduit 13. Consequently, not only moisture is absorbed through the porous drying cylinder 8, this being illustrated by arrows C, but the paper web 9 also remains attached against the drying cylinder 8 such that no supporting wire is required, cf. the wire 2 in FIG. 1. Wireless guide also avoids severe mechanical stress on the paper web (or other fibrous web). The difference between the pressures in the flow conduits 13 and 21 is between 0.1 and 60 kPa, preferably between 2 and 4 kPa. A slight overpressure is present in the flow conduit 13 and a slight negative pressure in the flow conduit 21.

Other heating units 30, which are also based on heating by electromagnetic waves, preferably infrared rays, are arranged below the drying cylinder B. These are also encircled by a casing 26 comprising an inlet 27 and an outlet 28. Reference numeral 42 denotes a cover resembling the cover 41. An air gap 31, like the gap 14 for the heating units 12, is arranged between adjacent heating units 30 in the longitudinal direction of the drying cylinder 8.

There is no fibrous web between the heating units 30 and the shell of the drying cylinder 8. The heating units act to heat the drying cylinder 8 and to discharge humid air from its surface. However, this indirectly results in more rapid dewatering of the fibrous web 9.

Reference numeral 40 denotes an inlet nip having ventilation. The inlet nip 40 is provided by negative pressure means 25 for keeping the fibrous web 9 pressed against the drying cylinder. The negative pressure means can be for instance suction devices (not shown), with which a negative pressure is provided inside the inner surface 11 of the drying cylinder 8, the negative pressure being lower than the one acting in the flow conduit 21. Such suction devices and negative pressure means are easily achieved by a person in the art, and they are therefore not described in any greater detail herein. Nip ventilation, i.e. suction of air from the inlet nip to the drying cylinder 8, can be arranged in the inlet nip.

Overpressure means 39 for freeing the fibrous web 9 from the drying cylinder 8 are arranged in the outlet nip of the drying cylinder 9. The overpressure means are typically air jets (not shown) which blow against the inner surface 11 of the drying cylinder 8. The overpressure means 39 see to it that a pressure which is higher than the air pressure in the inlet nip between the drying cylinder 8 and the turning cylinder 32 acts inside the inner surface 11 of the drying cylinder 8. Nip ventilation may also be arranged in this nip, i.e. suction of air from the inlet nip to the turning cylinder 32. The air guiding device 20 is provided with two non-pressurized zones 33, 34. A pressure advantageous to the durability may act in these zones. In other words, the pressure may be equal to or different from the pressure in the inlet 22.

Reference numeral 35 denotes a succeeding drying cylinder in the drying section of the invention.

When the drying section is used and a web break occurs, there are two alternative procedures:

1) the web is always run through the entire drying section,
2) the web is 'cut' at each turning cylinder 29, 32, which also have what is known as a web break sequence with overpressure blowing (cf. the overpressure means 25). The turning cylinders are arranged to move downwards. A non-pressurized zone 36, an overpressure zone 37 and a negative pressure and overpressure zone 38 act in the turning cylinders 29, 32. In web break, overpressure is activated in the middle segment of the overpressure zone 38.

The invention has been described above only by means of an example, and it is therefore pointed out that the details of the invention may vary in a variety of ways within the scope of the attached claims. The heating units 12, 30 may use electricity as the energy source instead of gas; but, nevertheless, the heating units are based on heating by electromagnetic waves having a wavelength activating water molecules. The number of heating units may vary (from one to several), as may the temperature and pressure in the flow conduits 13, 21. The shape of the blow devices 15, 26 outside the drying cylinder 8 and that of the air guiding device 20 inside the drying cylinder 8 may vary. The number of blow devices outside the drying cylinder may vary (from one to several). The air guiding device may comprise a plurality of arbitrarily pressurized zones for providing the desired differences in pressure, with the best result in mind. The number of drying cylinders may vary and they may be combined with conventional drying cylinders or conventional cylinder dryers.

What is claimed is:

1. A method of dewatering a fibrous web (9) in a drying section, preferably a paper web, cellulose web or cardboard web in a paper machine, in which method the fibrous web is heated for decreasing the moisture content thereof, the drying section comprising a number of drying cylinders (8), by which an inlet and outlet nip are formed when running the fibrous web, the drying section comprising dewatering devices for decreasing the moisture content of the fibrous web in which method the fibrous web (9) is guided against a porous drying cylinder (8), characterized by guiding the fibrous web (9) wirelessly against the porous drying cylinder (8), heating the fibrous web (9) within the drying section by radiation heat activating water molecules and directed towards the fibrous web and the drying cylinder (8), and providing by lateral blowing a humid airflow which sweeps in the machine direction along the surface of the fibrous web (9).

2. A drying section for dewatering a fibrous web (9), the drying section preferably being intended to dry fibrous webs in a paper machine, such as paper webs, cellulose webs or cardboard webs, and the drying section comprising a number of drying cylinders (8), by which an inlet and outlet nip are formed when running the fibrous web, the drying section comprising dewatering devices for decreasing the moisture content of the fibrous web, the dewatering devices comprising a blow device (15) for blowing air in the proximity of the surface of the fibrous web, and a porous drying cylinder (8) against which the fibrous web (9) is arranged to be guided, characterized by wireless guiding of the fibrous web (9) against the porous drying cylinder (8), and the dewatering devices comprising a heating unit (12) arranged within the drying section and at a distance from the shell surface of the porous drying cylinder (8) and directed towards the fibrous web (9) and drying cylinder, for heating the fibrous web, the heating unit being based on heating with rays having a wavelength which activates water molecules, and a blow device (15) comprising lateral blow devices arranged to provide a humid airflow which sweeps lengthwise along the surface of the fibrous web (9).

3. A drying section as claimed in claim 2, characterized in that the lateral blow devices are arranged to blow in a direction opposite to the movement of the fibrous web (9).

4. A drying section as claimed in claim 2, characterized in that the heating unit (12) is based on gas energy, the flame heat being guided without hindrance against the fibrous web (9).

5. A drying section as claimed in claim 2, characterized in that the heating unit is arranged at a distance from the shell surface (10) of the drying cylinder (8) such that a first flow conduit (13) for said humid air flow forms between the heating unit and the drying cylinder.

6. A drying section as claimed in claim 5, characterized in that the blow device comprises a casing (15) containing the heating units (12) and the first flow conduit (13).

7. A drying section as claimed in claim 2, characterized by at least two heating units (12) arranged along the shell surface (10) of the drying cylinder (8) at a distance from each other such that an air gap (14) forms between the heating units.

8. A drying section as claimed in claim 7, characterized by a plurality of heating units (12), arranged along the shell surface (10) of the drying cylinder (8), between which air gaps (14) are formed, respectively, the blow device comprising through-blowing devices for blowing humid air through the air gaps (14) against the fibrous web (9).

9. A drying section as claimed in claim 8, characterized in that the heating units (12) are arranged at a distance from the fibrous web (9) along the drying cylinder (8) at least mainly to follow the shape of a circular arc such that said first flow conduit (13) is formed between the heating units and the fibrous web.

10. A drying section as claimed in claim 9, characterized in that the heating units (12) are arranged along at least 100° of the periphery of the drying cylinder (8).

11. A drying section as claimed in claim 9, characterized in that the casing (15) is arranged to guide the air via the air gaps (14) and along the first flow conduit (13).

12. A drying section as claimed in claim 2, characterized in that a second flow conduit (21) for air flow is arranged under the shell (10) of the drying cylinder (8), the flow conduit being arranged to guide hot and humid air along the cylindrical inner surface (11) of the drying cylinder.

13. A drying section as claimed in claim 12, characterized in that the drying cylinder (8) is provided with an air inlet (22) and an air outlet (25) for air to and from the second flow conduit (21), respectively, the air pressure in the air inlet and the second flow conduit being arranged to be lower than the air pressure in the first flow conduit (13) to achieve a pressure difference and material transfer from the lower surface of the fibrous web (9) to the second flow conduit through the drying cylinder (8).

14. A drying section as claimed in claim 13, the through-blowing devices comprising an outlet (17), characterized in that the outlet (17) is coupled to the air inlet (22) in the drying cylinder (8) for discharging heated humid air from the outlet to the air inlet.

15. A drying section as claimed in claim 13, characterized in that the air inlet (22) is arranged close to the middle of a cylindrical air guiding device (20) having a central longitudinal conduit (39) and an outer diameter smaller than the inner diameter of the drying cylinder (8) for providing the second flow conduit (21), the air inlet being located inside the central conduit.

16. A drying section as claimed in claim 13, characterized in that overpressure means (39) are arranged at the outlet nip of the drying cylinder (8) for freeing the fibrous web (9) from the drying cylinder.

* * * * *

UNITED STATES PATENT AND TRADEMARK OFFICE

CERTIFICATE OF CORRECTION

PATENT NO. : 6,473,997 B1 
DATED : November 5, 2002
INVENTOR(S) : Berg

It is certified that error appears in the above-identified patent and that said Letters Patent is hereby corrected as shown below:

Title page,
Item [56], References Cited, U.S. PATENT DOCUMENTS, "Ilmarinen et al." should read -- Ilmarinen --.

Column 7,
Line 4, "claim 9" should read -- claim 10 --.

Signed and Sealed this

Eighteenth Day of March, 2003

JAMES E. ROGAN
*Director of the United States Patent and Trademark Office*